US005590469A

United States Patent [19]

Hoover et al.

[11] Patent Number: 5,590,469

[45] Date of Patent: Jan. 7, 1997

[54] ONE-HANDED KNIFE

[76] Inventors: Allen L. Hoover; Pamela A. Lyons, both of HCRI Box 145E, Free Union, Va. 22940

[21] Appl. No.: 578,016

[22] Filed: Dec. 26, 1995

[51] Int. Cl.[6] ..... B26B 7/00

[52] U.S. Cl. ..... 30/136; 30/277.4

[58] Field of Search ..... 30/124, 272.1, 30/275.4, 277.4, 286, 289, 290, 296.1, 136

[56] References Cited

U.S. PATENT DOCUMENTS

| | | | |
|---|---|---|---|
| 3,376,640 | 4/1968 | Kramer et al. | 30/272.1 |
| 3,664,021 | 5/1972 | Sawyer | 30/277.4 |
| 3,740,845 | 6/1973 | Klein | 30/136 |
| 4,497,113 | 2/1985 | Haws | 30/124 |
| 4,711,030 | 12/1987 | Ruston, Sr. | 30/277.4 |
| 4,890,386 | 1/1990 | Collier | 30/272.1 X |

*Primary Examiner*—Hwei-Siu Payer

[57] ABSTRACT

A one-handed knife with associated claws for holding an object while being cut is disclosed. A handle with a central linear axis is formed of a rigid material having an open forward end and a closed rearward end with a cylindrical opening extending rearwardly from the open forward end. A cutting blade has a central curved axis and a downwardly facing cutting edge. A motor is located within the handle adjacent to the open end with an associated power source couplable with respect to the motor to impart electrical power to the motor. A coupling member having a forward end secured to the blade and a rearward end secured to the motor is provided to transmit a reciprocating motion of the motor to the blade for cutting purposes. A pair of resilient claws is secured to the handle and extend forwardly toward the forward end of the blade at an angle upwardly and away from the blade to a region above the blade. The resilient claws then extend downwardly essentially perpendicular to the blade axis and terminate in points, the resilient claws being located on opposite sides of the cutting blade.

4 Claims, 2 Drawing Sheets

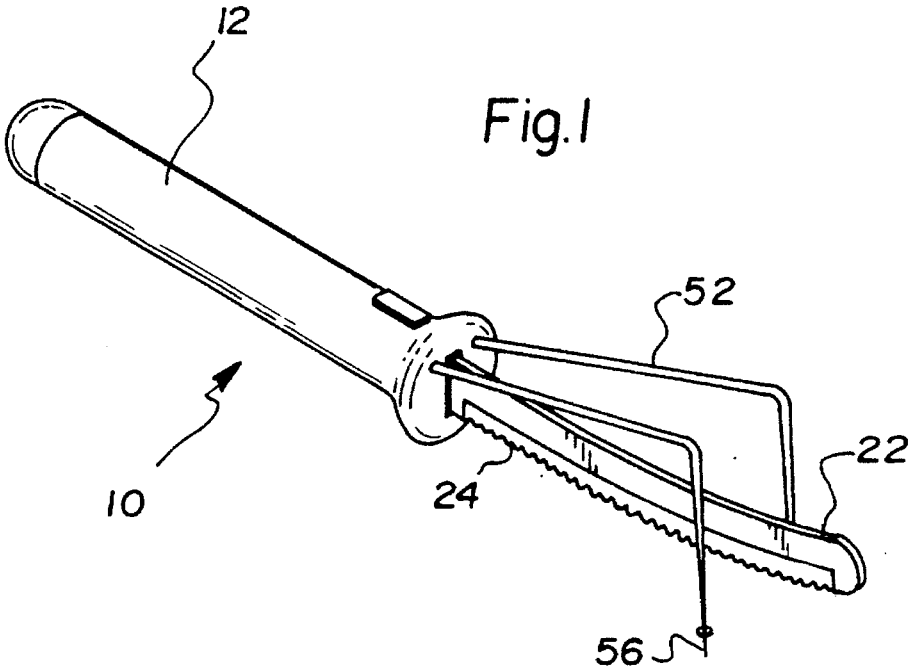
Fig. 1
Fig. 2
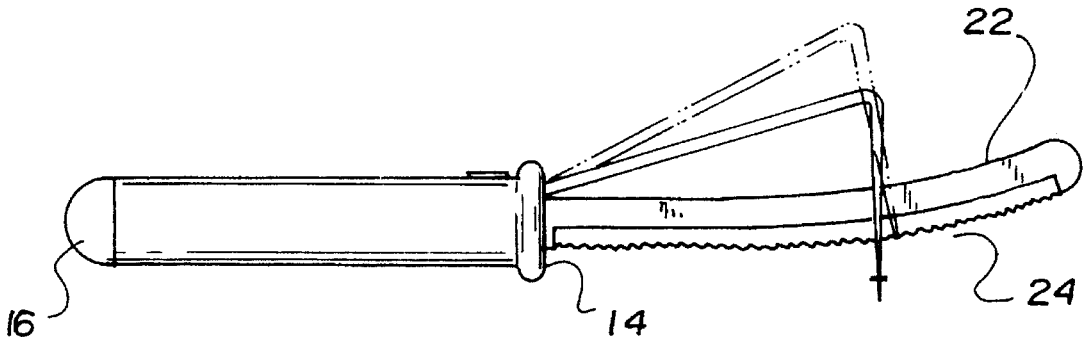

ONE-HANDED KNIFE

BACKGROUND OF THE INVENTION

1. Field of the Invention

The present invention relates to a new and improved one-handed knife and, more particularly, pertains to utilizing claws for holding meat or other objects being carved by an electric knife.

2. Description of the Prior Art

The use of knives, forks, and combinations thereof in various designs and configurations is known in the prior art. More specifically, knives, forks, and combinations thereof in various designs and configurations heretofore devised and utilized for the purpose of cutting and/or holding meat or other objects through various methods and apparatuses are known to consist basically of familiar, expected, and obvious structural configurations, notwithstanding the myriad of designs encompassed by the crowded prior art which has been developed for the fulfillment of countless objectives and requirements.

The prior art discloses a large number of devices for utilizing claws for holding meat or other objects being carved by an electric knife. By way of example, U.S. Pat. No. 3,747,211 to Calabrese discloses a safety handle for knives.

U.S. Pat. No. 4,675,996 to DuBuque discloses a box knife.

U.S. Pat. No. 4,897,922 to Brooker discloses a folding knife.

U.S. Pat. No. 5,349,753 to Gaffney discloses a one-handed knife system.

Lastly, U.S. Pat. No. 5,361,497 to Crawford discloses a folding knife holder and method for one-handed opening of a folding knife.

In this respect, the one-handed knife with associated claws according to the present invention substantially departs from the conventional concepts and designs of the prior art, and in doing so provides an apparatus primarily developed for the purpose of utilizing claws for holding meat or other objects being carved by an electric knife.

Therefore, it can be appreciated that there exists a continuing need for a new and improved one-handed knife with associated claws which can be used for utilizing claws for holding meat or other objects being carved by an electric knife. In this regard, the present invention substantially fulfills this need.

SUMMARY OF THE INVENTION

In view of the foregoing disadvantages inherent in the known types of knives, forks, and combinations thereof in various designs and configurations now present in the prior art, the present invention provides an improved one-handed knife with associated claws. As such, the general purpose of the present invention, which will be described subsequently in greater detail, is to provide a new and improved one-handed knife with associated claws and methods which have all the advantages of the prior art and none of the disadvantages.

To attain this, the present invention essentially comprises a new and improved one-handed knife with associated claws for holding an object while being cut comprising, in combination, an essentially cylindrical handle with a central linear axis formed of a rigid material having an open forward end and a closed rearward end with a cylindrical opening extending rearwardly from the open forward end; a cutting blade having a central curved axis essentially co-extensive with the central axis of the cylindrical handle at is inboard end, the blade also having a downwardly facing cutting edge; a cylindrical motor located within the handle adjacent to the open end with an associated cylindrical battery secured within the handle between the motor and the closed end to impart electrical power to the motor and with an associated switch on the exterior surface of the handle to selectively energize the battery to drive the motor; a coupling member having a forward end secured to the blade and a rearward end secured to the motor to transmit a reciprocating motion of the motor to the knife for cutting purposes; a radial enlargement on the handle adjacent to the open end with an annular bushing secured within the enlargement and encompassing the blade adjacent to its rearward end; and a pair of resilient claws secured to the bushing, the resilient claws extending forwardly toward the forward end of the blade at an angle upwardly and away from the resilient claws at an angle of between about 10 and 20 degrees to a region above the blade, the resilient claws then extending downwardly essentially perpendicular to the knife axis from a location above the blade to a location beneath the blade and terminating in points, the resilient claws being located on opposite sides of the knife blade and diverging equally and oppositely outwardly from the blade to provide a holding force to meat and other objects being cut during the reciprocation of the blade.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved one-handed knife with associated claws which has all the advantages of the prior art knives, forks, and combinations thereof in various designs and configurations and none of the disadvantages.

It is another object of the present invention to provide a new and improved one-handed knife with associated claws which may be easily and efficiently manufactured and marketed.

It is a further object of the present invention to provide a new and improved one-handed knife with associated claws which is of a durable and reliable construction.

An even further object of the present invention is to provide a new and improved one-handed knife with associated claws which is susceptible of a low cost of manufacture with regard to both materials and labor, and which accordingly is then susceptible of low prices of sale to the consuming public, thereby making such knives, forks, and combinations thereof in various designs and configurations economically available to the buying public.

Still yet another object of the present invention is to provide a new and improved one-handed knife with associated claws which provides in the apparatuses and methods of the prior art some of the advantages thereof, while simultaneously overcoming some of the disadvantages normally associated therewith.

Even still another object of the present invention is to utilize claws for holding meat or other objects being carved by an electric knife.

Lastly, it is an object of the present invention to provide a one-handed knife with associated claws for holding an object while being cut. A handle with a central linear axis is formed of a rigid material having an open forward end and a closed rearward end with a cylindrical opening extending rearwardly from the open forward end. A cutting blade has a central curved axis and a downwardly facing cutting edge. A motor is located within the handle adjacent to the open end with an associated power source couplable with respect to the motor to impart electrical power to the motor. A coupling member having a forward end secured to the blade and a rearward end secured to the motor is provided to transmit a reciprocating motion of the motor to the knife for cutting purposes. A pair of resilient claws is secured to the handle and extend forwardly toward the forward end of the blade at an angle upwardly and away from the resilient claws to a region above the blade. The resilient claws then extend downwardly essentially perpendicular to the knife axis and terminate in points, the resilient claws being located on opposite sides of the knife blade.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective illustration of the preferred embodiment of the new and improved one-handed knife with associated claws constructed in accordance with the principles of the present invention.

FIG. 2 is a side elevational view of the device shown in FIG. 1.

The same reference numerals refer to the same parts throughout the various Figures.

DESCRIPTION OF THE PREFERRED EMBODIMENT

Figure 3:
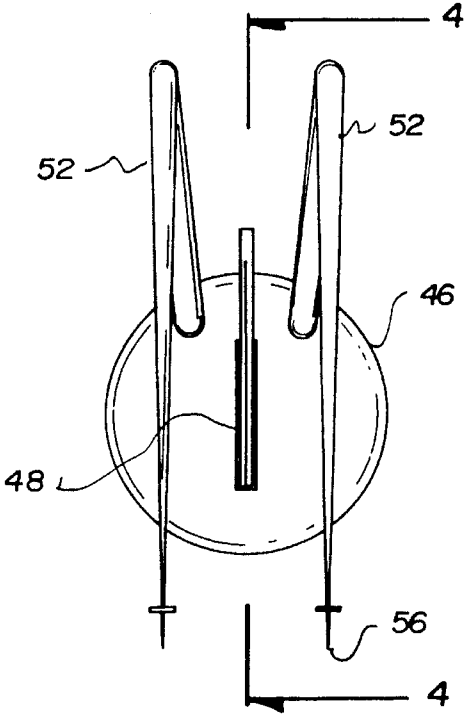
FIG. 3 is a front elevational view of the device shown in the prior Figures.
Figure 4:
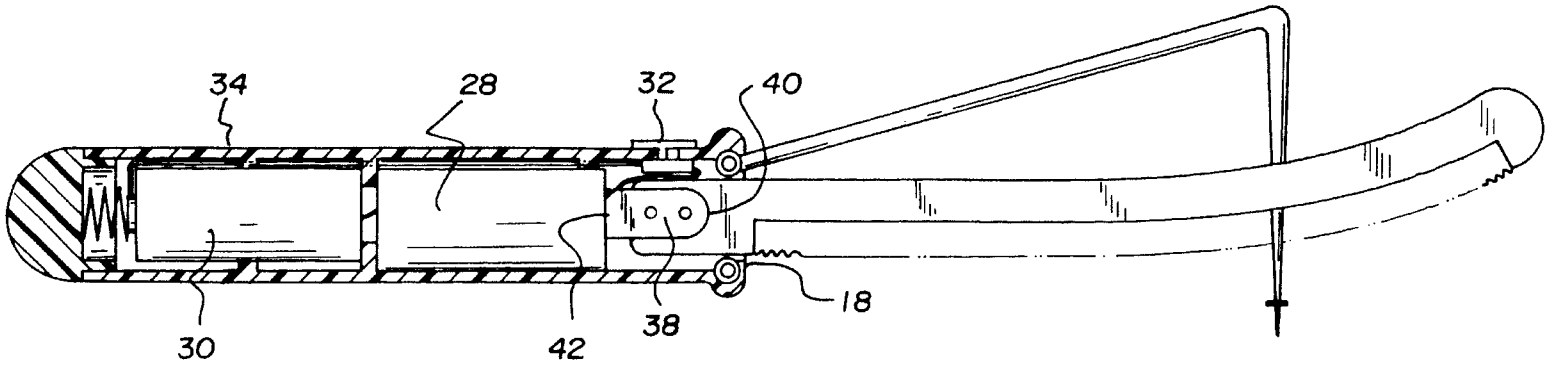
FIG. 4 is a cross-sectional view taken along line 4—4 of FIG. 3.

With reference now to the drawings, and in particular to FIG. 1 thereof, the preferred embodiment of the new and improved one-handed knife with associated claws embodying the principles and concepts of the present invention and generally designated by the reference numeral 10 will be described.

The present invention, the new and improved one-handed knife with associated claws is a system 10 comprised of a plurality of components. In their broadest context, the components include a handle, a cutting blade, a cylindrical motor, a radial enlargement and a pair of resilient claws. Each of the individual components is specifically configured and correlated one with respect to the other so as to attain the desired objectives.

The present invention may be considered a system 10. Such system has as its central component an essentially cylindrical handle 12. Such handle is formed with a central linear axis. The handle is preferably fabricated of a rigid material as of plastic. It is formed with an open forward end 14 and a closed rearward end 16. It has a cylindrical opening 18 extending rearwardly from the open forward end through the entire length of the handle terminating in the closed rearward end.

Next provided is a cutting blade 22. The cutting blade is flat and slightly curved for a greater cutting length. It has a central curved axis which is essentially co-extensive with the central axis of the cylindrical handle at its inboard end. The blade also has a downwardly facing cutting edge 24 for cutting meat or other objects to be cut.

Within the handle is a cylindrical motor 28. The motor is located within the handle adjacent to the open end. It has in association therewith a cylindrical battery 30. The battery is secured within the handle between the motor and the closed end. The battery functions to impart electrical power to the motor. In association with the motor and battery is an associated switch 32. The switch is located on an exterior surface 34 of the handle and extends therethrough. The function of the switch is to selectively energize the battery to drive the motor during operation and use.

The present invention, in an alternate embodiment, may also be powered through an electrical outlet utilizing a conventional electric cord and plug rather than through the use of batteries. The electric cord would be located at the closed rearward end of the handle and would preferably employ a swivel mechanism for greater ease of use by the operator. Such embodiment would also employ an on/off switch to selectively energize the motor during operation and use.

The next component of the system 10 is a coupling member 38. Such coupling member has a forward end 40 secured to the blade. The coupling member also has a rearward end 42 secured to the motor. The function of the coupling member is to transmit a reciprocating motion of the motor to the knife. This is for cutting purposes.

Next provided is a radial enlargement 46. Such radial enlargement is located on the handle. It is positioned adjacent to the open end. The enlargement has therein an annular bushing 48. The bushing is secured within the enlargement. It is located to centrally encompass the blade adjacent to the rearward end of the blade.

Lastly provided are a pair of resilient claws 52. The resilient claws have rearward ends spaced apart from the bushing. The resilient claws extend forwardly toward the forward end of the blade but terminate adjacent the midpoint of the blade. The claws extend at an angle upwardly and away from the blade at an angle of between about 10 and 15 degrees, preferably about 20 degrees. They extend to a region above the blade.

The resilient claws then extend downwardly essentially perpendicular to the knife axis from a location above the blade to a location beneath the blade. The free ends of the claws remote from the handle terminate in points 56. Such points are for puncturing and securing the object to be cut by the blade.

The resilient claws are located on opposite sides of the blade and diverge equally and oppositely outwardly from the blade. The claws thus provide a holding force to meat or other objects being cut during the reciprocation of the blade.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved one-handed knife with associated claws for holding an object while being cut comprising, in combination:

an essentially cylindrical handle with a central linear axis formed of a rigid material having an open forward end and a closed rearward end with a cylindrical opening extending rearwardly from the open forward end;

a cutting blade having a central curved axis essentially co-extensive with the central axis of the cylindrical handle, the blade also having a downwardly facing cutting edge;

a cylindrical motor located within the handle adjacent to the open end with an associated cylindrical battery secured within the handle between the motor and the closed end to impart electrical power to the motor and with an associated switch on the exterior surface of the handle to selectively energize the battery to drive the motor;

a coupling member having a forward end secured to the blade and a rearward end secured to the motor to transmit a reciprocating motion of the motor to the blade for cutting purposes;

a radial enlargement on the handle adjacent to the open end with an annular bushing secured within the enlargement and encompassing the blade adjacent to its rearward end; and a pair of resilient claws secured to the handle, the resilient claws extending forwardly toward the forward end of the blade at an angle upwardly and away from the blade at an angle of between about 10 and 20 degrees to a region above the blade, the resilient claws then extending downwardly essentially perpendicular to the blade axis from a location above the blade to a location beneath the blade and terminating in points, the resilient claws being located on opposite sides of the cutting blade and diverging equally and oppositely outwardly from the blade to provide a holding force to meat and other objects being cut during the reciprocation of the blade.

2. A one-handed knife with associated claws for holding an object while being cut comprising:

a handle with a central linear axis formed of a rigid material having an open forward end and a closed rearward end with a cylindrical opening extending rearwardly from the open forward end;

a cutting blade having a central axis, the blade also having a downwardly facing cutting edge;

a motor located within the handle adjacent to the open end with an associated power source couplable with respect to the motor to impart electrical power to the motor;

a coupling member having a forward end secured to the blade and a rearward end secured to the motor to transmit a reciprocating motion of the motor to the blade for cutting purposes; and a pair of resilient claws secured to the handle, the resilient claws extending forwardly toward the forward end of the blade at an angle upwardly and away from the blade to a region above the blade, the resilient claws then extending downwardly essentially perpendicular to the blade axis from a location above the blade to a location beneath the blade and terminating in points, the resilient claws being located on opposite sides of the cutting blade.

3. The knife as set forth in claim 2 and further including a radial enlargement on the handle adjacent to the open end with an annular bushing secured within the enlargement and encompassing the blade adjacent to its rearward end.

4. The knife as set forth in claim 2 and further including an associated switch on the exterior surface of the handle to selectively energize the power source to drive the motor.

* * * * *